US010691155B2

(12) United States Patent
Marinca

(10) Patent No.: US 10,691,155 B2
(45) Date of Patent: Jun. 23, 2020

(54) SYSTEM AND METHOD FOR A PROPORTIONAL TO ABSOLUTE TEMPERATURE CIRCUIT

(71) Applicant: Infineon Technologies AG, Neubiberg (DE)

(72) Inventor: Stefan Marinca, Baia Mare (RO)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 16/129,308

(22) Filed: Sep. 12, 2018

(65) Prior Publication Data

US 2020/0081475 A1 Mar. 12, 2020

(51) Int. Cl.
*G05F 3/20* (2006.01)

(52) U.S. Cl.
CPC ..... *G05F 3/20* (2013.01)

(58) Field of Classification Search
CPC ..... G05F 3/16; G05F 3/20; G05F 3/08; G05F 3/26; G05F 3/30; G05F 3/222; G05F 3/242; G05F 3/245
See application file for complete search history.

(56) References Cited

U.S. PATENT DOCUMENTS

| | | | | |
|---|---|---|---|---|
| 5,349,286 | A | 9/1994 | Marshall et al. | |
| 6,864,741 | B2 * | 3/2005 | Marsh | G05F 3/30 323/315 |
| 7,274,250 | B2 | 9/2007 | Hazucha et al. | |
| 8,169,256 | B2 * | 5/2012 | Yao | G05F 3/30 323/313 |
| 9,218,015 | B2 | 12/2015 | Marinca | |
| 9,285,820 | B2 | 3/2016 | Kalb et al. | |
| 9,323,275 | B2 | 4/2016 | Marinca | |
| 2005/0194957 | A1 * | 9/2005 | Brokaw | G05F 3/30 323/316 |
| 2006/0181335 | A1 * | 8/2006 | Hsu | G05F 3/30 327/539 |
| 2013/0200878 | A1 * | 8/2013 | Kalb | G05F 3/20 323/313 |

* cited by examiner

*Primary Examiner* — Jue Zhang
*Assistant Examiner* — Kevin H Sprenger
(74) *Attorney, Agent, or Firm* — Slater Matsil, LLP

(57) ABSTRACT

In accordance with an embodiment, a proportional to absolute temperature (PTAT) circuit includes a first bipolar transistor having a collector coupled to a common node; a second bipolar transistor having a collector coupled to the common node; a MOSFET having a load path coupled between a base of the first bipolar transistor and a base of the second bipolar transistor; and an amplifier having a first input coupled to an emitter of the first bipolar transistor, a second input coupled to an emitter of the second bipolar transistor and an output coupled to a gate of the MOSFET.

22 Claims, 6 Drawing Sheets

SYSTEM AND METHOD FOR A PROPORTIONAL TO ABSOLUTE TEMPERATURE CIRCUIT

TECHNICAL FIELD

The present invention relates generally to a system and method for a proportional to absolute temperature (PTAT) circuit.

BACKGROUND

One of the most ubiquitous circuits used in the field of integrated circuit is the so-called "bandgap" voltage reference, which strives to produce a temperature independent voltage. Such bandgap voltages are used, for example, to produce reference voltages and bias currents for a wide variety of analog circuits, and can be found in wide variety of circuits including memory circuits, data converter circuits, voltage regulators, power supplies, and RF circuits.

The temperature independent voltage of the bandgap voltage reference is generally produced by combining an output of a circuit that generates a DC signal that is proportional to absolute temperature (PTAT) with an output of a circuit that generates a DC signal that is complimentary to absolute temperature (CTAT). A common method of producing a PTAT DC voltage is to generate a voltage difference between the base-emitter junctions of two bipolar transistors operating a different collector current densities, while a common method of producing a CTAT signal involves monitoring a base-emitter voltage of a bipolar transistor or a junction voltage of a diode, which are generally inversely proportional to temperature.

While the general concept behind producing a temperature independent voltage is straightforward, the practical implementation of such circuits is challenging. When implemented using semiconductor processes that exhibit statistical variation in terms of process parameters and feature geometry, voltage reference circuits become prone to part-to-part and lot-to-lot variation that affects both in the nominally generated DC reference and the performance of the voltage reference over temperature.

SUMMARY

In accordance with an embodiment, a proportional to absolute temperature (PTAT) circuit includes a first bipolar transistor having a collector coupled to a common node; a second bipolar transistor having a collector coupled to the common node; a MOSFET having a load path coupled between a base of the first bipolar transistor and a base of the second bipolar transistor; and an amplifier having a first input coupled to an emitter of the first bipolar transistor, a second input coupled to an emitter of the second bipolar transistor and an output coupled to a gate of the MOSFET.

In accordance with another embodiment, a method of generating a proportional to absolute temperature (PTAT) voltage uses a PTAT circuit including a first bipolar transistor having a collector coupled to a common node, a second bipolar transistor having a collector coupled to the common node, a MOSFET having a load path coupled between a base of the first bipolar transistor and a base of the second bipolar transistor, and an amplifier having a first input coupled to an emitter of the first bipolar transistor, a second input coupled to an emitter of the second bipolar transistor and an output coupled to a gate of the MOSFET. The method includes generating a ΔVbe voltage at the base of the second bipolar transistor.

In accordance with a further embodiment of the present invention, a voltage reference includes a plurality of proportional to absolute temperature (PTAT) cells, where each of the plurality of the PTAT cells includes a first bipolar transistor having a base coupled to an input node and a collector coupled to a common node, a second bipolar transistor having a collector coupled to the common node, a MOSFET having a load path coupled between a base of the second bipolar transistor and the input node, and an amplifier having a first input coupled to an emitter of the first bipolar transistor, a second input coupled to an emitter of the second bipolar transistor and an output coupled to a gate of the MOSFET. In various embodiments, the input node of a first PTAT cell of the plurality of PTAT cells is connected to the common node, and an output node of the first PTAT cell of the plurality of PTAT cells is connected to an input node of a subsequent PTAT cell of the plurality of PTAT cells.

In accordance with a further embodiment of the present invention, a voltage reference circuit includes a first bipolar transistor having an emitter coupled to a common node; a second bipolar transistor having an emitter coupled to a common node; a first current source coupled to the common node; a MOSFET having a load path coupled between a base of the first bipolar transistor and a base of the second bipolar transistor; and an amplifier having a first input coupled to a collector of the first bipolar transistor, a second input coupled to a collector of the second bipolar transistor and an output coupled to a gate of the MOSFET.

BRIEF DESCRIPTION OF THE DRAWINGS

For a more complete understanding of the invention, and the advantages thereof, reference is now made to the following descriptions taken in conjunction with the accompanying drawings, in which.

Figure 1A:
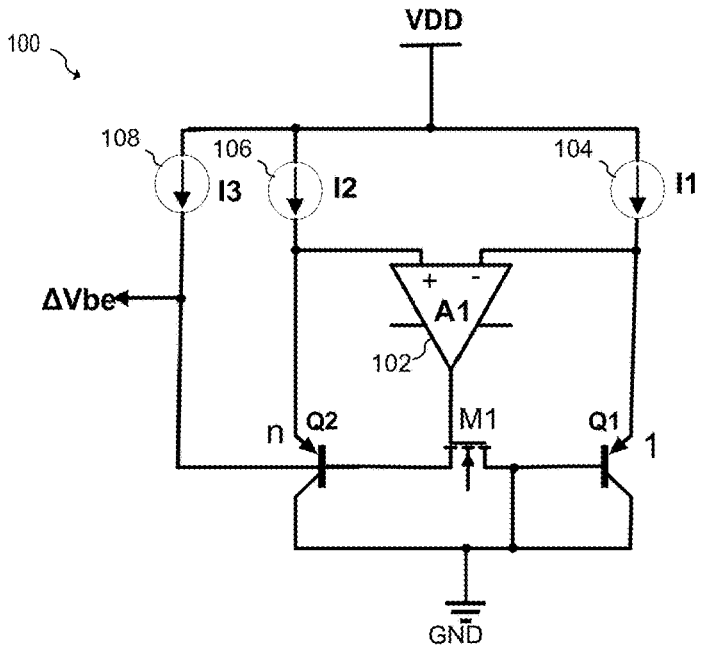
FIGS. 1A and 1B illustrate embodiment PTAT circuits.

Corresponding numerals and symbols in different figures generally refer to corresponding parts unless otherwise indicated. The figures are drawn to clearly illustrate the relevant aspects of the preferred embodiments and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, a system and method for a PTAT circuit for use in a temperature independent voltage reference, such as a bandgap voltage reference. The invention, however, may also be applied to temperature sensors, as well a variety of electronic circuits that utilize voltage reference circuits and/or bias generators. For example, embodiment PTAT circuits can be used to provide a temperature dependent signal in the design of an electronic thermometer, and/or may be used to monitor a die temperature or environmental temperature in an embodiment system.

In various embodiments, a PTAT circuit includes two bipolar transistors having collectors connected to a common node and a MOSFET connected between the bases of the two bipolar transistors. A feedback amplifier forces the emitters of the two transistors to have the same voltage by adjusting the voltage across the MOSFET. Thus, if the base of one transistor is connected to the common node, the voltage difference between the base of the remaining transistor and the common node is $\Delta V_{BE}$. In some embodiments, multiple PTAT circuits can be cascaded to produce voltages that are multiples of $\Delta V_{BE}$.

Embodiments of the present invention are advantageous in that the output produced by embodiment PTAT circuits is insensitive to base currents. This insensitivity to base currents also translates into insensitivity to base current mismatch and variation and insensitivity to base current noise, which is known to have a very high 1/f noise component. Thus, the output of embodiment PTAT circuits may advantageously exhibit very low part-to-part and lot-to-lot variation and exhibit very low 1/f noise. Cascaded or stacked embodiments also advantageously exhibit very low sensitivity to base currents and amplifier offset.

In some embodiments, collectors of the bipolar transistors used to implement embodiment PTAT circuits are coupled to the same node. Thus, embodiment PTAT circuits can be implemented using substrate PNP transistors that are available in bulk digital CMOS processes. This advantageously allows for high performance PTAT circuits to be produced in an inexpensive and/or digital CMOS process without the need for high performance bipolar transistors. A further advantage of some embodiments includes the ability to implement accurate voltage references and temperature sensors without the need for trimming, which saves costs in terms of process steps required to fabricate fuses or non-volatile memory (to save trim parameters), and saves test costs. This is especially advantageous with respect to high volume parts.

FIG. 1A illustrates a PTAT circuit 100 according to an embodiment of the present invention that includes two PNP bipolar transistors Q1 and Q2, a MOS transistor M1, an amplifier 102, and three current sources 104, 106 and 108 that generate corresponding bias currents I1, I2 and I3. As shown, current source 104 biases transistor Q1 at a first current density and current source I2 biases transistor Q2 at a second current density such that the difference in base-emitter voltage of transistors Q1 and Q2 is:

$$\Delta V_{be} = \frac{kT}{q}\ln\left(n\frac{I1}{I2}\right), \tag{1}$$

where, k is Boltzmann's constant, T is absolute temperature in Kelvin, q is electron charge and n is the ratio of the area of the emitter of transistor Q2 to the area of the emitter of transistor Q1 (also referred to the emitter area ratio). For the case where I1=I2, $\Delta V_{BE}$ can be expressed as:

$$\Delta V_{be} = \frac{kT}{q}\ln(n), \tag{2}$$

For ease of explanation, the relationship of I1=I2 and n>1 will be assumed in the description of embodiments herein such that the current density ratio is n. However, it should be understood that in alternative embodiments, a non-unity ratio of I1 to I2 may be used depending on the particular embodiment and its specifications.

In some embodiments, transistors Q1 and Q2 are implemented using a plurality of unit devices such in order to achieve the desired emitter area ratio n. For example, transistor Q1 may be implemented using a single unit device and transistor Q2 may be implemented using n unit devices. Thus, an emitter area ratio of 4 may be achieved by transistor Q1 with a single unit device and transistor Q2 with 4 unit devices. Transistors Q1 and Q2 may be physically laid out using good layout matching techniques known in the art. For example, the unit devices that comprise transistors Q1 and Q2 may be arranged using common centroid layout techniques.

As shown, the base of transistor Q1 is connected to ground, and the load path of transistor M1 is connected between the base of transistor Q2 and the base of transistor Q1. The output of amplifier 102 is connected to the gate of transistor M1, while the inputs of amplifier 102 are connected to the respective emitters of transistors Q1 and Q2, thereby forming a feedback loop that includes amplifier 102, transistor M1 and transistor Q2. During operation, the loop gain of the feedback loop forces the emitter voltage of transistor Q2 to be approximately the same as the emitter voltage of transistor Q1. When this condition is satisfied, the base voltage of transistor Q2 is:

$$\Delta V_{BE}=V_{BE1}-V_{BE2}. \tag{3}$$

Current I3 provided by current source 108, along with the base current of transistor Q2 sets the drain current for MOSFET M1. Because the base voltage of transistor Q2 is set by the feedback loop, output voltage $\Delta V_{BE}$ is independent of the base currents of transistors Q1 and Q2. Accordingly, accurate operation of PTAT circuit 100 can be achieved using PNP bipolar transistors that have very low DC current gain β. In addition, because the collectors of transistors Q1 and Q2 are connected to ground (also referred to as a "common node"), transistors Q1 and Q2 are suitable for implementation using substrate PNP transistors. Lateral PNP transistors as well, can be easily implemented using inexpensive bulk CMOS processes without the need for extra process steps.

Figure 1B:
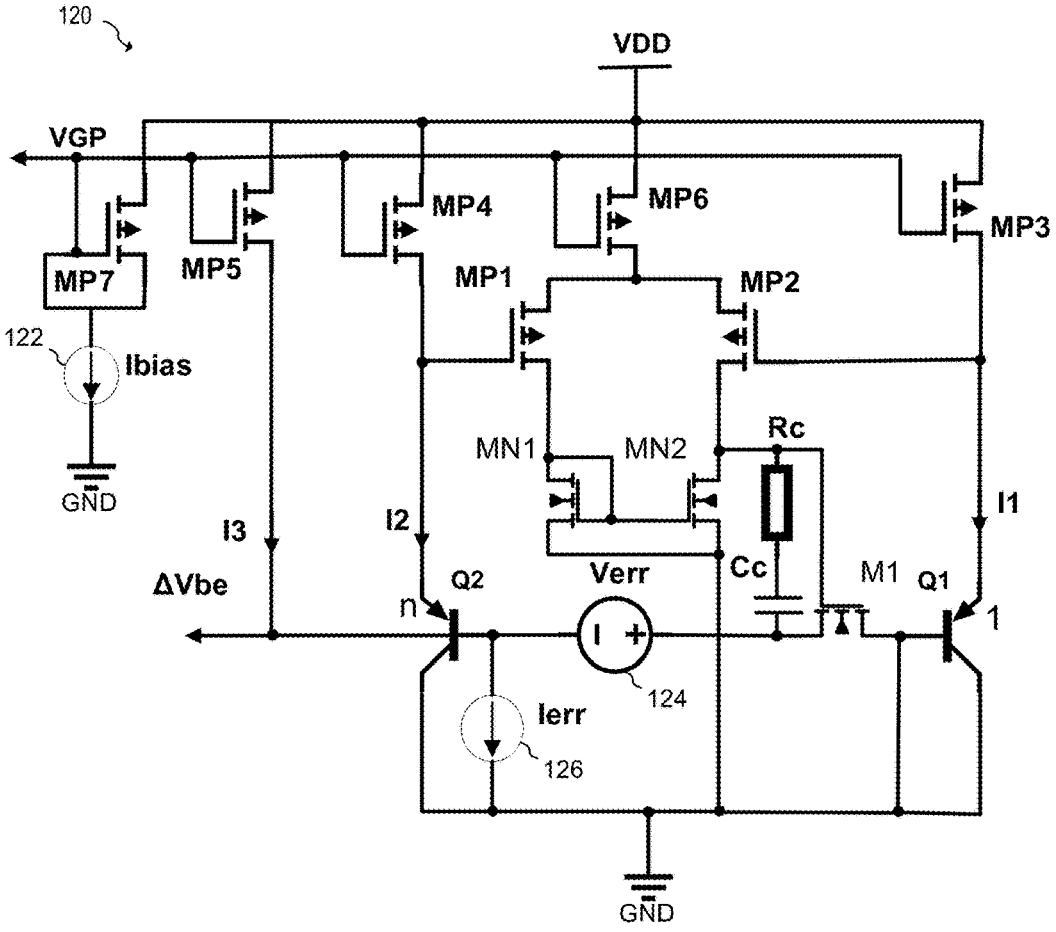

FIG. 1B illustrates PTAT circuit 120 that can be used to implement PTAT circuit 100 (FIG. 1A) in a small geometry CMOS process. As shown, current sources 104, 106 and 108 of FIG. 1A are implemented using PMOS transistors MP3, MP4 and MP5, respectively. Amplifier 102 (FIG. 1A) is implemented using a single-stage CMOS amplifier that includes a differential pair having PMOS transistors MP1 and MP2, and an active load having NMOS transistors MN1 and MN2. The combination of the single-stage CMOS amplifier, NMOS transistor M1 and PMOS transistor MP5 form a circuit that is similar in structure to a two-stage CMOS operational amplifier. Accordingly, resistor Rc and capacitor Cc are coupled in series between the output of the single-stage CMOS amplifier (which is coupled to the gate of NMOS transistor M1) and the drain of NMOS transistor M1 to form a stability compensation network. This stability compensation network establishes a dominant pole for amplifier, and the series combination of resistor Rc and Cc introduces a zero that further enhances the stability of the amplifier.

PMOS transistor MP6 functions as a current source that sets the tail current of the differential pair. Bias voltage VGP is supplied to PMOS transistors MP3, MP4, MP5 and MP6, and may be set using diode connected PMOS transistor MP7 and current source 122 that supplies bias current Ibias. Alternatively, other bias generation circuits known in the art may be used to generate bias voltage VGP.

In one example embodiment, all current mirror transistors, MP3, MP4, MP5, MP6, and MP7 have a width of 5 μm and a length of 10 μm, and are configured to have a temperature independent bias current of 1 μA. The bias currents of the two transistors generating the base-emitter voltage difference can be PTAT, CTAT or temperature independent. In various embodiments, the two bias currents track each other such that the ratio of the two current remain essentially constant over the temperature range. It is also possible to use the two currents of different temperature coefficients. For example, one way to reduce the output voltage curvature is to introduce a negative curvature based on a base-emitter voltage difference that is opposite of the base-emitter voltage curvature. A simple way to do this is to bias the high collector current density bipolar transistor with PTAT current and the low collector current density bipolar transistor with a temperature independent current. In some embodiments, PTAT circuit 120 may include a start-up circuit known in the art (not shown) to ensure that the system starts up in the proper state.

In the example embodiment, PMOS transistors MP1 and MP2 that implement the differential pair and NMOS transistors MN1 and MN2 have a width of 24 μm and a length of 4 μm, and NMOS transistor M1 has a width of 13 μm and a length of 0.5 μm. Transistors Q1 and Q2 are implemented using unit substrate PNP bipolar transistors having a DC current gain β of about 1.5. Transistor Q1 is implemented using a single unit PNP bipolar transistor and transistor Q2 is implemented using eight unit PNP bipolar transistors connected in parallel. One advantage of using bipolar transistors that have a very low DC current gain β (such as substrate PNP bipolar transistors) is that DC current gain β does not vary much over collector current. This weak dependence of DC current gain β on collector current helps makes the $\Delta V_{BE}$ produced by PTAT circuit 120 more independent of DC current gain β of transistors Q1 and Q2.

It should be understood that these geometric parameters and device parameters represent only one specific example. In alternative embodiments, other geometric parameters and device parameters may be used depending on the particular system and its specifications.

Voltage source 124 represents a simulation error voltage Verr, and current source 126 represents a simulation error current Ierr that can be used to demonstrate the insensitivity of the above-described embodiment of PTAT circuit 120 to voltage and/or current errors. In a simulation of the above-described embodiment of PTAT circuit 120, varying error voltage Verr+/−5.4 mV produces a variation of about +/−1.6 μV in the output $\Delta V_{BE}$ (assuming a nominal $\Delta V_{BE}$ of about 64 mV). This corresponds to a $\Delta V_{BE}$ error of about +/−0.003%. Varying error current Ierr+/−200 nA (representing a 50% variation in the base current of transistor Q2) produces a variation of about +/−13.6 μV in the output $\Delta V_{BE}$. This corresponds to a $\Delta V_{BE}$ error of about +/−0.025%.

Figure 2A:
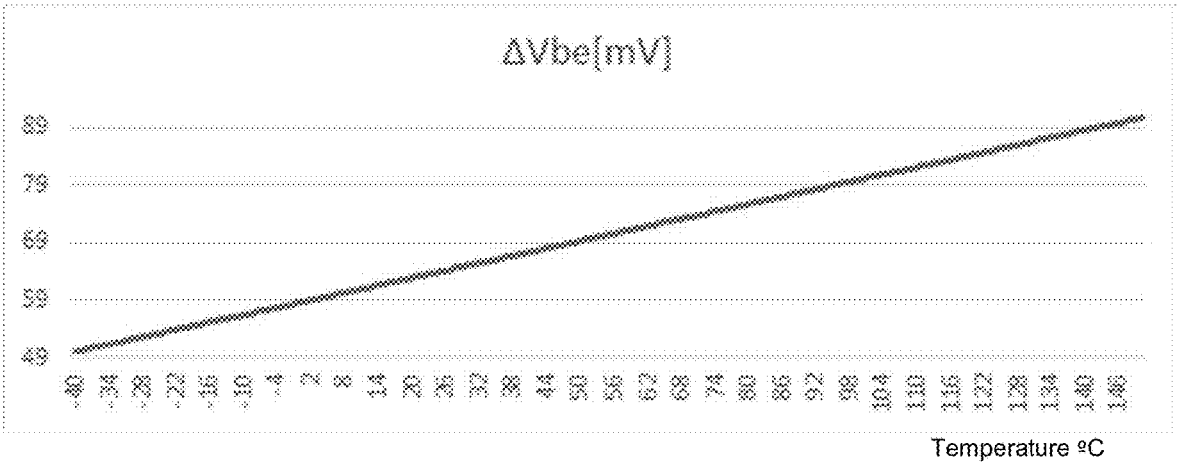
FIGS. 2A and 2B illustrate waveform diagrams depicting the performance of the PTAT circuit of FIG. 1B.
Figure 2B:
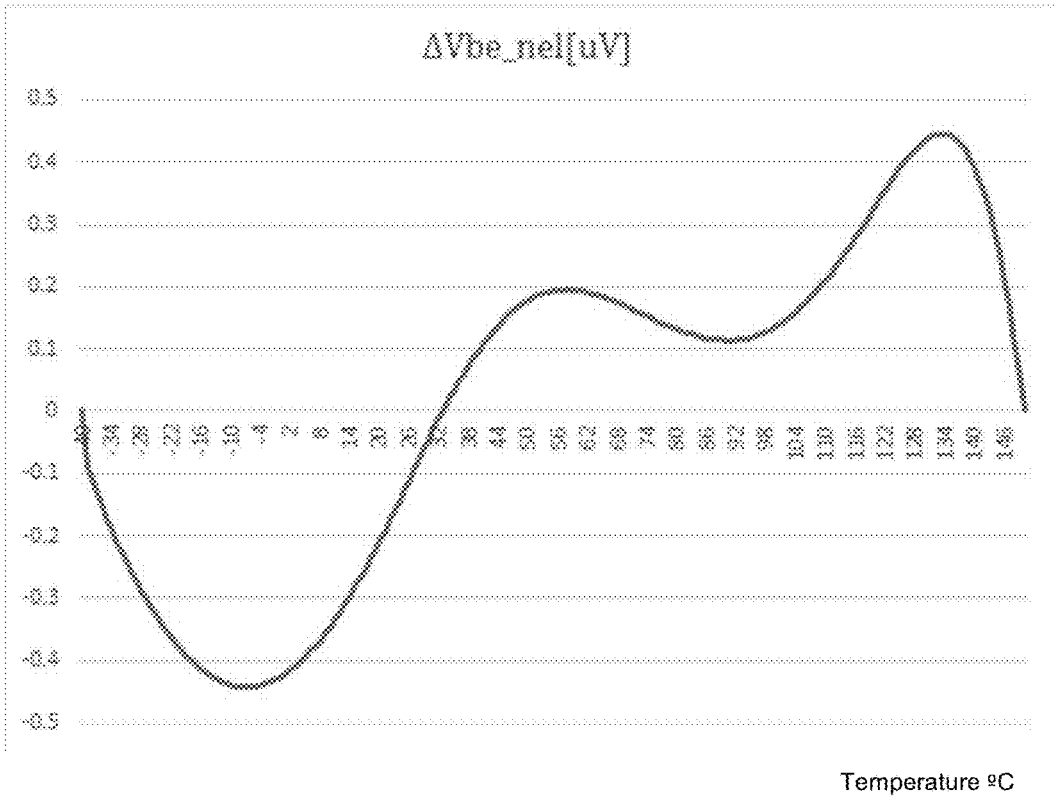

Simulated base-emitter voltage difference ΔVbe and its corresponding nonlinearity for PTAT circuit 120 (FIG. 1B) are plotted in FIGS. 2A and 2B, respectively. As can be seen in FIG. 2A, $\Delta V_{BE}$ varies from about 49 mV to about 89 mV over a temperature range of −40° C. to 150° C. This represents a temperature sensitivity of about 180 uV/° C. The nonlinearity of ΔVbe over the temperature range of −40° C. to 150° C. is less than 0.5 μV, representing about 0.001% error from its nominal value.

Figure 3:
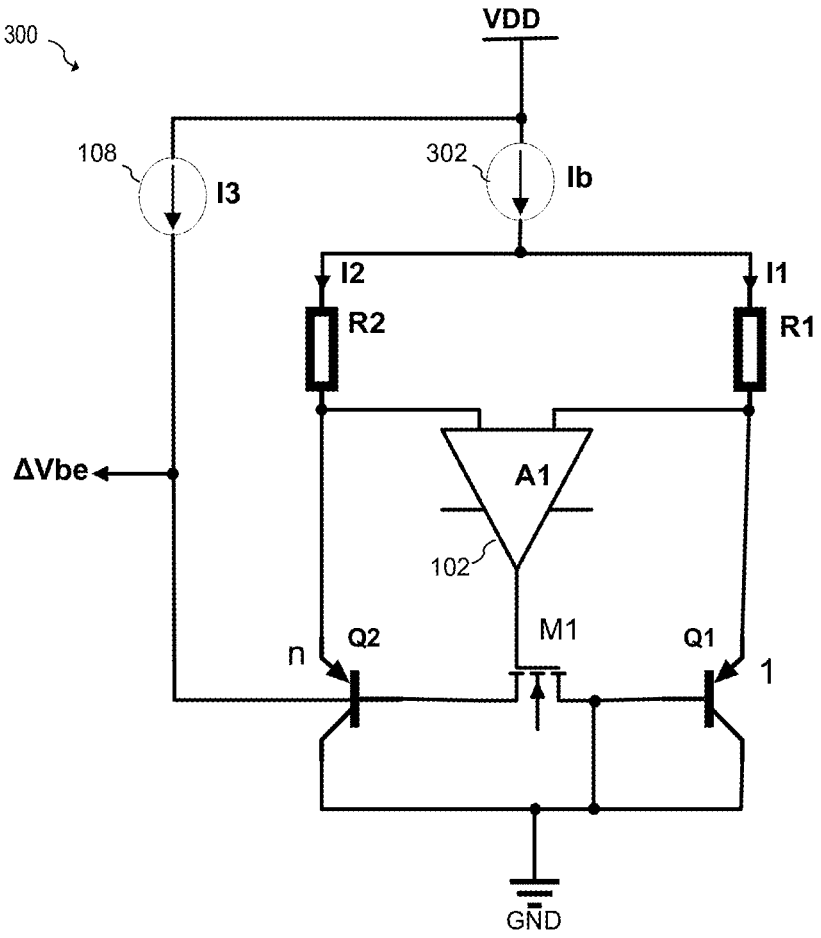
FIG. 3 illustrates a PTAT circuit according to another embodiment of the present invention.

FIG. 3 illustrates PTAT circuit 300 according to a further embodiment of the present invention. PTAT circuit 300 is similar to PTAT circuit 100 illustrated in FIG. 1A with the addition of current source 302 that supplies the emitters of both Q1 and Q2 with bias current Ib. Current sources 104 and 106 are replaced by a single current source 302 and resistors R1 and R2 which split current Ib into two currents I1 and I2. By splitting current Ib into currents I1 and I2, the effect of mismatch between currents I1 and I2 is compensated, thereby making ΔVbe more insensitive to mismatch between I1 and I2. In various embodiments, current sources 108 and 302 may be implemented using PMOS transistors coupled between power supply node VDD and resistors R1 and R2, and amplifier 102 may be implemented using a single-stage CMOS amplifier in a manner similar to the embodiment of FIG. 1B. In alternative embodiments, other circuits known in the art may be used to implement current sources 108 and 302 and amplifier 102.

Figure 4:
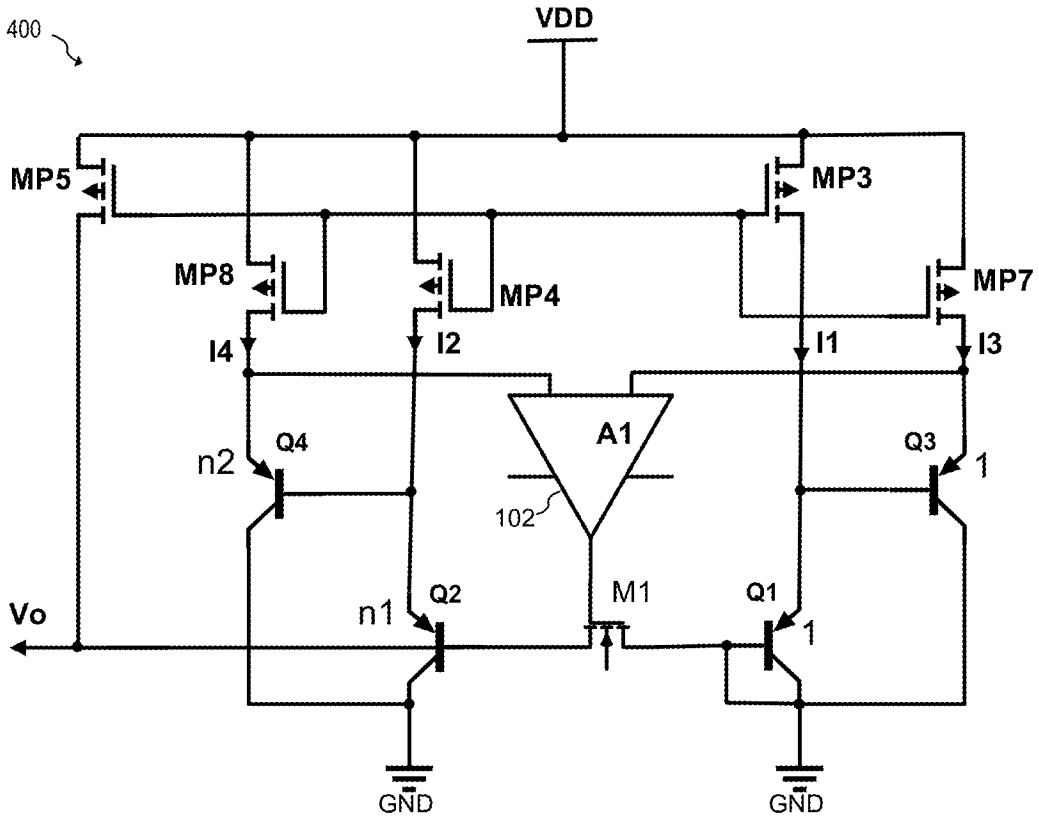
FIG. 4 illustrates a PTAT circuit according to a further embodiment of the present invention.

FIG. 4B illustrates PTAT circuit 400 according to a further embodiment. As shown, the high current density side of the PTAT circuit includes transistor Q1 and transistor Q3 having a base coupled to the emitter of transistor Q1. Similarly, the low current density side of the circuit includes transistor Q2 and transistor Q4 having a base coupled to the emitter of transistor Q2. In the depicted embodiment, transistors Q1 and Q3 have the same emitter area, the ratio of the emitter area of transistor Q2 to the emitter area of either transistor Q1 or Q3 is n1, and the ratio of the emitter area of transistor Q4 to the emitter area of either transistor Q1 or Q3 is n2. PMOS transistors MP3, MP4, MP7 and MP8 function as current sources that supply currents I1, I2, I3 and I4 to transistors Q1, Q2, Q3 and Q4. NMOS transistor M1 is coupled between the bases of transistors Q1 and Q2, and PMOS transistor MP5 functions as a current source that provides drain current to NMOS transistor M1.

The output of amplifier 102 is coupled to the gate of NMOS transistor M1, and the inputs of amplifier 102 are connected to the emitters of transistors Q3 and Q4. Thus, during operation, amplifier 102 adjusts the gate voltage of NMOS transistor M1 until the emitter voltages of transistors Q3 and Q4 are substantially equal. Accordingly, the output voltage Vo can be expressed as:

$$Vo = \frac{kT}{q}\ln\left(n1 \cdot n2 \cdot \frac{I1 \cdot I3}{I2 \cdot I4}\right). \tag{4}$$

For n1=n2=n and I1=I2=I2=I4, the output voltage Vo can be expressed as:

$$V_0 = \frac{kT}{q}\ln(n^2) = 2\frac{kT}{q}\ln(n), \tag{5}$$

which is twice the output voltage produced by PTAT circuits 100, 120 and 300 depicted in FIGS. 1A, 1B and 3.

In various embodiments the principle of operation of PTAT circuit 400 is similar to the principle of operation of embodiment PTAT circuits 100, 120 and 300 described above with respect to FIGS. 1A, 1B and 3 with the exception that the input of amplifier 102 operates at a voltage of $2V_{BE}$ instead of at a voltage of $V_{BE}$, and the output voltage of the circuit is twice the output voltage of the other embodiments. Thus, in addition to having the advantages of current and device mismatch insensitivity detailed with respect to the embodiments described above, PTAT circuit 400 has less sensitivity to the offset and noise of amplifier 102.

Figure 5:
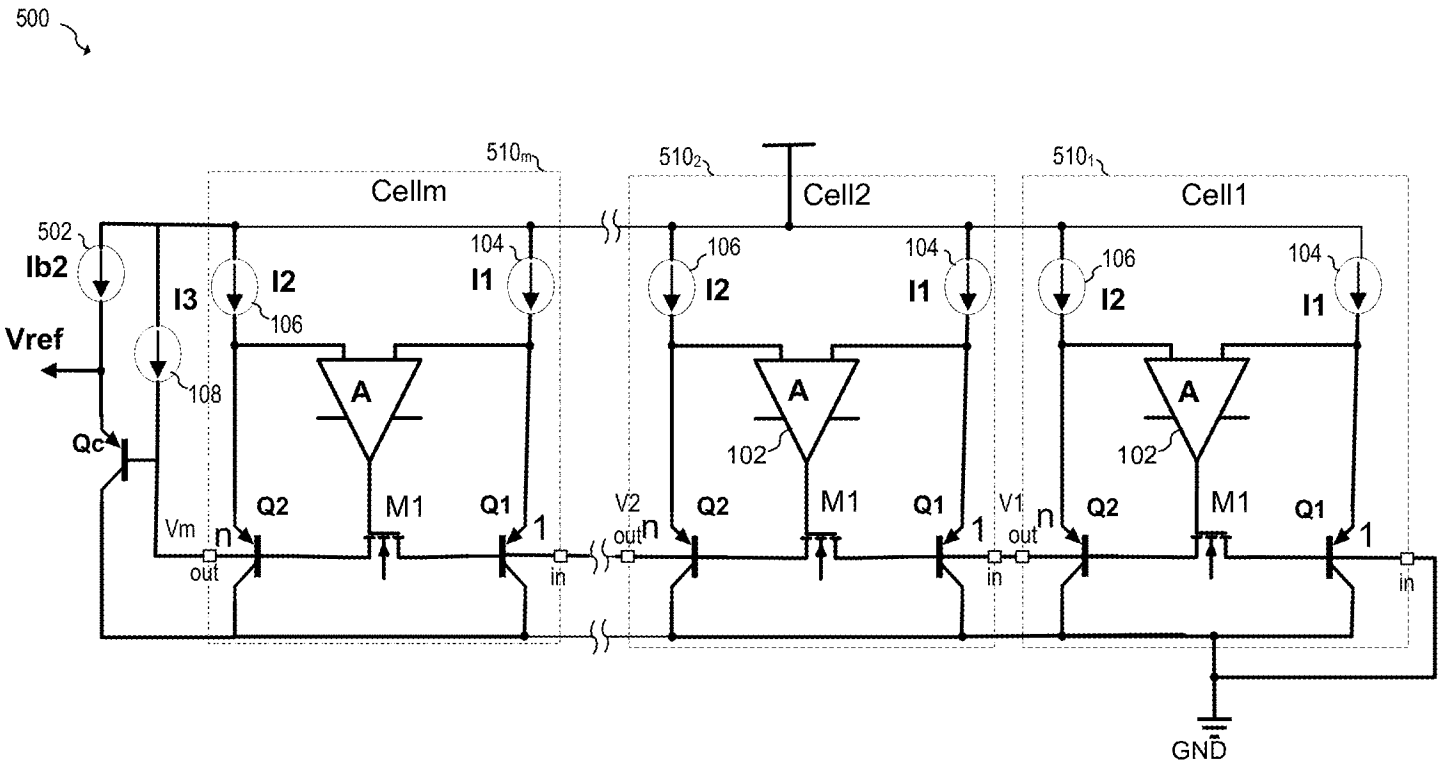
FIG. 5 illustrates a voltage reference circuit that includes a plurality of embodiment PTAT circuits.

FIG. 5 illustrates voltage reference circuit 500 that may be configured to produce a temperature independent bandgap voltage Vref. As shown, voltage reference circuit 500 includes m cascaded PTAT cells $\mathbf{510}_1$ to $\mathbf{510}_m$ that are configured to produce a PTAT voltage of mΔVbe at node Vm, and a voltage Vref. (PTAT cells $\mathbf{510}_1$ to $\mathbf{510}_m$ may also be referred to as PTAT circuits or base-emitter voltage reference cells.) The PTAT voltage at node Vm is applied to the base of transistor Qc to produce a voltage of $Vref=Vbe_{Qc}+m\Delta Vbe$ at the emitter of transistor Qc, where $Vbe_{Qc}$ is the base-emitter voltage of transistor Qc. Since mΔVbe is a PTAT voltage and $Vbe_{Qc}$ is a CTAT voltage, a temperature independent voltage Vref can be produced by the judicious selection of emitter areas and bias currents of the various components of voltage reference circuit 500. The main advantage of this configuration is related to the fact that the errors such offsets and noise voltages do not correlate one to another so as the PTAT voltage is added cell by cell, but the errors are added as square root of the sum of squared errors. Assuming that the "i" cell generates a base-emitter voltage ΔVbe(i) and it is affected by its one error voltage 'verr' we have:

$$V_{PTAT} = \sum_{i=1}^{n} \Delta V_{be}(i) \tag{6}$$

$$V_{err} = \sqrt{\sum_{i=1}^{n} v_{err}^2(i)} \tag{7}$$

For a stack of nine identical cells the output PTAT voltage will be $V_{PTAT}=9\ \Delta V_{be}$ (1) and $V_{err}=3V_{err}$(1).

For simplicity of illustration, only three PTAT cells $\mathbf{510}_1$, $\mathbf{510}_2$ and $\mathbf{510}_m$ are shown; however, any number of PTAT cells may be used. Each PTAT cell $\mathbf{510}_1$ to $\mathbf{510}_m$ includes PNP transistors Q1 and Q2, NMOS transistor M1, and current sources 104 and 106 and operates in a similar manner as the embodiment of FIG. 1A described above. While the structure of the PTAT cell of FIG. 1A is used as an illustration for the embodiment of FIG. 5, each PTAT cell $\mathbf{510}_1$ to $\mathbf{510}_m$ can be configured to incorporate the circuit topology of other PTAT cell embodiments disclosed herein.

Each PTAT cell $\mathbf{510}_1$ to $\mathbf{510}_m$ is shown having an input node coupled to the base of transistor Q1 and an output node coupled to the base of transistor Q2, such that the output node of one PTAT cell is coupled to the input node of its immediately adjoining PTAT cell. For example, the input node of the first PTAT cell $\mathbf{510}_1$ is connected to ground GND, and the output node of first PTAT cell $\mathbf{510}_1$ is connected to the input node of second PTAT cell $\mathbf{510}_2$. The output node Vm of the last PTAT cell $\mathbf{510}_m$, however, is connected to the base of transistor Qc and to current source 108 that supplies the drain current for the NMOS transistors M1 of PTAT cells $\mathbf{510}_1$ to $\mathbf{510}_m$. Current source 502 supplies bias current Ib2 to transistor Qc.

Because input node of PTAT cell $\mathbf{510}_1$ is coupled to ground, the output node V1 of PTAT cell $\mathbf{510}_1$ has a voltage of ΔVbe with respect to ground. Because the input node of PTAT cell $\mathbf{510}_2$ is coupled to node V1 having a voltage of ΔVbe (instead of to ground), output node V2 of PTAT cell $\mathbf{510}_2$ has a voltage of ΔVbe+V1=2 ΔVbe. Thus, when voltage reference circuit 500 is implemented using m PTAT cells, the output voltage Vm of PTAT cell $\mathbf{510}_m$ is mΔVbe.

The drain current of NMOS transistor M1 of PTAT cell $\mathbf{510}_m$ includes the base currents of transistors Q1 and Q2 of PTAT cell $\mathbf{510}_m$, as well as the base current of transistor Qc. Because of the cascaded structure of PTAT cells $\mathbf{510}_1$ to $\mathbf{510}_m$, the drain current of NMOS transistor M1 of each subsequent PTAT cell carries the drain current of it previous cell in addition to the base current of transistors Q1 and Q2 of its own cell. As a result, the drain current of NMOS transistor M1 increases with each subsequent PTAT cell. Because of this, the feedback loop in each PTAT cell $\mathbf{510}_1$ to $\mathbf{510}_m$ is compensated separately to ensure the stability of each cell. In some embodiments, a compensation network, such as the compensation network including resistor Re and capacitor Cc in FIG. 1B may be used in conjunction with each amplifier 102. As described above with respect to the various embodiments above, embodiment PTAT cells have very low sensitivity to the base current of transistors Q1 and Q2 and to voltage errors at the bases of transistors Q1 and Q2. Accordingly, the reference voltage Vref generated by voltage reference circuit 500 has a low sensitivity to process variation and device mismatch.

In some embodiments, each PTAT cell $\mathbf{510}_1$ to $\mathbf{510}_m$ can be implemented using identical circuitry. However, in alternative embodiments, emitter area ratio n and bias currents I1 and I2 can be adjusted on a cell-by-cell basis to fine tune the PTAT current.

Figure 6:
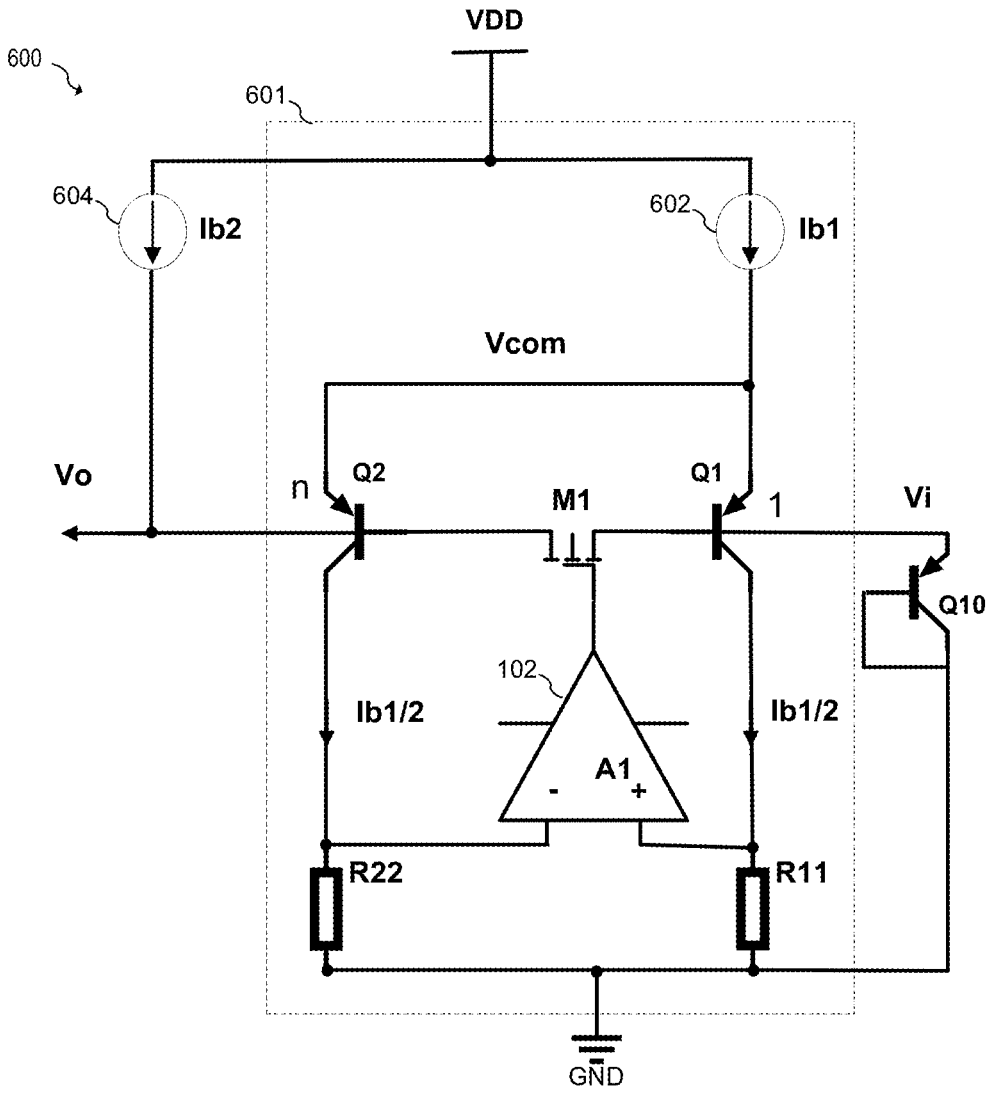
FIG. 6 illustrates a voltage reference circuit according to a further embodiment of the present invention.

FIG. 6 illustrates a voltage reference circuit 600 according to a further embodiment of the present invention, which includes a PTAT core circuit 601 coupled between transistor Q10 at node V1 and current source 604 at output node Vo. As shown, PTAT core circuit 601 includes transistor Q1 and transistor Q2 having an emitter area that is n times the emitter ratio of transistor Q1. Similar to the embodiments described above, NMOS transistor M1 is connected between the bases of transistors Q1 and Q2. However, unlike the embodiments described above, the emitters of transistors Q1 and Q1 are connected to a common node Com, while the collectors of transistors Q1 and Q2 are connected to the inputs of amplifier 102. Also, unlike the other embodiments describe above, the inputs of amplifier 102 are connected to the collectors of transistors Q1 and Q2.

As shown current source 602 provides current Ib1 that is split between transistors Q1 and Q2, and current source 604 provides current Ib2 that provides drain current NMOS transistor M1. In various embodiments current sources 602 and 604 may be implemented using transistor-based current sources, such as current sources utilizing PMOS transistors and/or PNP bipolar transistors. In some embodiments, however, current source 602 may be implemented using a resistor. Resistor R11 is coupled between the collector of transistor Q1 and ground; and resistor R22 is coupled between the collector of transistor Q2 and ground. In some embodiments, resistors R11 and R22 can be replaced by active current sources, such as current sources utilizing NMOS transistors and/or NPN bipolar transistors.

During operation, amplifier 102 adjusts the gate voltage of NMOS transistor M1 until the collector voltage of transistor Q2 is substantially equal to the collector voltage of transistor Q1. When this condition is met, and assuming that R1=R2, the voltage difference between output node Vo and input node V1 is a PTAT voltage that can be expressed as:

$$Vo - Vi = \frac{kT}{q}\ln(n). \tag{8}$$

In some embodiments, the addition of transistor Q3 provides a CTAT component for output voltage Vo:

$$Vo = \frac{kT}{q}\ln(n) + V_{EB10}, \tag{9}$$

where $V_{EB10}$ is the emitter-base voltage of transistor Q10. In some embodiments, additional PTAT terms may be added by cascading additional instances of PTAT core 601 between nodes Vo and V1 in a similar manner as the embodiment of FIG. 5. However, in such embodiments, output transistor Qc is not necessary because transistor Q10 provides the requisite CTAT component. In some embodiments, output voltage Vo can be made to be temperature independent by the judicious selection of emitter area ratios and number of stages.

In various embodiments, transistor Q10 helps keep transistors Q1 and Q2 out of saturation in addition to providing a CTAT component for output voltage Vo. In some embodiments, transistor Q10 may be omitted and/or replaced by a voltage source having a sufficient voltage to ensure that transistors Q1 and Q2 stay out of saturation. In further alternative embodiments, bipolar transistor Q3 can be replaced with a different voltage source in order to force the base-collector voltages of Q1 and Q2 to be high enough to keep Q1 and Q2 out of saturation. Unlike the previous circuit arrangements where the amplifier controls the two emitter voltages at the same potential, voltage reference circuit 600 of FIG. 6 controls the collector voltages to be at substantially the same potential. The result is that the input offset voltage of amplifier 102 generates a corresponding collector current variation that is logarithmically related to the base-emitter voltage difference. Thus, in some embodiments, voltage reference circuit 600 of FIG. 6 can be about ten times less sensitive to offset voltage of amplifier 102 compared to the circuit of FIG. 1.

All of the embodiments disclosed above may be implemented, for example, on a single monolithic semiconductor substrate using a wide variety of different semiconductor technologies. Some embodiment PTAT circuits and voltage reference circuits may be implemented using bipolar, CMOS, and BiCMOS processes known in the art. CMOS processes may include, for example, bulk CMOS processes, CMOS processes using thin or thick film silicon on insulator (SOI) or other processes.

Example embodiments of the present invention are summarized here. Other embodiments can also be understood from the entirety of the specification and the claims filed herein.

Example 1

A proportional to absolute temperature (PTAT) circuit including: a first bipolar transistor having a collector coupled to a common node; a second bipolar transistor having a collector coupled to the common node; a MOSFET having a load path coupled between a base of the first bipolar transistor and a base of the second bipolar transistor; and an amplifier having a first input coupled to an emitter of the first bipolar transistor, a second input coupled to an emitter of the second bipolar transistor and an output coupled to a gate of the MOSFET.

Example 2

The PTAT circuit of example 1, where the base of the first bipolar transistor is coupled to the common node.

Example 3

The PTAT circuit of one of examples 1 or 2, where the common node is coupled to ground.

Example 4

The PTAT circuit of one of examples 1 to 3, further including: a first current source coupled to the emitter of the first bipolar transistor; and a second current source coupled to the emitter of the second bipolar transistor.

Example 5

The PTAT circuit of example 4, where the first current source and the second current source each includes an active current source.

Example 6

The PTAT circuit of one of examples 4 or 5, further including a third current source coupled to the base of the second bipolar transistor.

Example 7

The PTAT circuit of one of examples 1 to 6, further including a first current source; a first resistor coupled between the emitter of the first bipolar transistor and the first current source; a second resistor coupled between the emitter of the second bipolar transistor and first current source; and a second current source coupled to the base of the second bipolar transistor.

Example 8

The PTAT circuit of one of examples 1 to 7, where the amplifier includes a single-stage CMOS amplifier.

Example 9

The PTAT circuit of example 8, further including a compensation network coupled between the output of the amplifier and the base of the second bipolar transistor, the compensation network including a resistor coupled in series with a capacitor.

Example 10

The PTAT circuit of one of examples 1 to 9, where: the first bipolar transistor and the second bipolar transistor are disposed on a semiconductor substrate; and the first bipolar transistor and the second bipolar transistor each includes a substrate PNP bipolar transistor.

Example 11

The PTAT circuit of one of examples 1 to 10, further including a third bipolar transistor having a collector coupled to the common node, and a base coupled to the emitter of the first bipolar transistor; a fourth bipolar transistor having a collector coupled to the common node, and a base coupled to the emitter of the second bipolar transistor, where the first input of the amplifier is coupled to the emitter of the third bipolar transistor, and is thereby coupled to the emitter of the first bipolar transistor via the third bipolar transistor, and the second input of the amplifier is coupled to the emitter of the fourth bipolar transistor, and is thereby coupled to the emitter of the second bipolar transistor via the fourth bipolar transistor; and a third current source coupled to the base of the second bipolar transistor.

Example 12

A method of generating a proportional to absolute temperature (PTAT) voltage using a PTAT circuit including a first bipolar transistor having a collector coupled to a common node, a second bipolar transistor having a collector coupled to the common node, a MOSFET having a load path coupled between a base of the first bipolar transistor and a base of the second bipolar transistor, and an amplifier having a first input coupled to an emitter of the first bipolar transistor, a second input coupled to an emitter of the second bipolar transistor and an output coupled to a gate of the MOSFET, the method including: generating a ΔVbe voltage at the base of the second bipolar transistor.

Example 13

The method of example 12, further including: providing a first current to the emitter of the first bipolar transistor using a first current source; providing a second current to the emitter of the second bipolar transistor using a first current source; and providing a second current to the base of the second bipolar transistor and to the load path of the MOSFET using a third current source.

Example 14

A voltage reference including: a plurality of proportional to absolute temperature (PTAT) cells, where each of the plurality of the PTAT cells includes a first bipolar transistor having a base coupled to an input node and a collector coupled to a common node, a second bipolar transistor having a collector coupled to the common node, a MOSFET having a load path coupled between a base of the second bipolar transistor and the input node, and an amplifier having a first input coupled to an emitter of the first bipolar transistor, a second input coupled to an emitter of the second bipolar transistor and an output coupled to a gate of the MOSFET, where the input node of a first PTAT cell of the plurality of PTAT cells is connected to the common node, and an output node of the first PTAT cell of the plurality of PTAT cells is connected to an input node of a subsequent PTAT cell of the plurality of PTAT cells.

Example 15

The voltage reference of example 14, where each of the plurality of PTAT cells further includes: a first current source coupled to the emitter of the first bipolar transistor; and a second current source coupled to the emitter of the second bipolar transistor.

Example 16

The voltage reference of one of examples 14 or 15, further including a bias current source coupled to the output node of a last PTAT cell of the plurality of PTAT cells.

Example 17

The voltage reference of one of examples 14 to 16, further including an output bipolar transistor having an emitter coupled to the common node, a base coupled to the output node of the last PTAT cell of the plurality of PTAT cells, and an emitter coupled to a reference voltage output node of the voltage reference.

Example 18

The voltage reference of one of examples 14 to 17, where the first bipolar transistor and the second bipolar transistor of each of the plurality of PTAT cells each includes a PNP bipolar transistor.

Example 19

A voltage reference circuit including: a first bipolar transistor having an emitter coupled to a common node; a second bipolar transistor having an emitter coupled to a common node; a first current source coupled to the common node; a MOSFET having a load path coupled between a base of the first bipolar transistor and a base of the second bipolar transistor; and an amplifier having a first input coupled to a collector of the first bipolar transistor, a second input coupled to a collector of the second bipolar transistor and an output coupled to a gate of the MOSFET.

Example 20

The voltage reference circuit of example 19, further including a second current source coupled to the base of the second bipolar transistor; a first resistor coupled between the collector of the first bipolar transistor and a first power supply node; and a second resistor coupled between the collector of the second bipolar transistor and the first power supply node.

Example 21

The voltage reference circuit of one of examples 19 or 20, further including a third bipolar transistor coupled between the base of the first bipolar transistor and the first power supply node.

Example 22

The voltage reference circuit of example 21, where the first bipolar transistor, the second bipolar transistor, and the third bipolar transistor each includes a PNP bipolar transistor.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A proportional to absolute temperature (PTAT) circuit comprising:

a first bipolar transistor having a collector coupled to a common node;

a second bipolar transistor having a collector coupled to the common node;

a MOSFET having a load path operatively coupled between a base of the first bipolar transistor and a base of the second bipolar transistor; and an amplifier having a first input coupled to an emitter of the first bipolar transistor, a second input coupled to an emitter of the second bipolar transistor and an output coupled to a gate of the MOSFET, wherein the load path of the MOSFET is disposed within a circuit path that is connected between the base of the first bipolar transistor and the base of the second bipolar transistor, wherein the circuit path does not include the emitters and collectors of the first bipolar transistor and the second bipolar transistor, and does not include a power supply node.

2. The PTAT circuit of claim 1, wherein the base of the first bipolar transistor is coupled to the common node.

3. The PTAT circuit of claim 2, wherein the common node is coupled to ground.

4. The PTAT circuit of claim 1, further comprising:

a first current source coupled to the emitter of the first bipolar transistor; and a second current source coupled to the emitter of the second bipolar transistor.

5. The PTAT circuit of claim 4, wherein the first current source and the second current source each comprises an active current source.

6. The PTAT circuit of claim 4, further comprising a third current source coupled to the base of the second bipolar transistor.

7. The PTAT circuit of claim 1, further comprising a first current source;

a first resistor coupled between the emitter of the first bipolar transistor and the first current source;

a second resistor coupled between the emitter of the second bipolar transistor and first current source; and a second current source coupled to the base of the second bipolar transistor.

8. The PTAT circuit of claim 1, wherein the amplifier comprises a single-stage CMOS amplifier.

9. The PTAT circuit of claim 8, further comprising a compensation network coupled between the output of the amplifier and the base of the second bipolar transistor, the compensation network comprising a resistor coupled in series with a capacitor.

10. The PTAT circuit of claim 1, wherein:

the first bipolar transistor and the second bipolar transistor are disposed on a semiconductor substrate; and the first bipolar transistor and the second bipolar transistor each comprises a substrate PNP bipolar transistor.

11. The PTAT circuit of claim 1, further comprising a third bipolar transistor having a collector coupled to the common node, and a base coupled to the emitter of the first bipolar transistor;

a fourth bipolar transistor having a collector coupled to the common node, and a base coupled to the emitter of the second bipolar transistor, wherein the first input of the amplifier is coupled to the emitter of the third bipolar transistor, and is thereby coupled to the emitter of the first bipolar transistor via the third bipolar transistor, and the second input of the amplifier is coupled to the emitter of the fourth bipolar transistor, and is thereby coupled to the emitter of the second bipolar transistor via the fourth bipolar transistor; and a third current source coupled to the base of the second bipolar transistor.

12. A method of generating a proportional to absolute temperature (PTAT) voltage using a PTAT circuit comprising a first bipolar transistor having a collector coupled to a common node, a second bipolar transistor having a collector coupled to the common node, a MOSFET having a load path operatively coupled between a base of the first bipolar transistor and a base of the second bipolar transistor, and an amplifier having a first input coupled to an emitter of the first bipolar transistor, a second input coupled to an emitter of the second bipolar transistor and an output coupled to a gate of the MOSFET, wherein the load path of the MOSFET is disposed within a circuit path that is connected between the base of the first bipolar transistor and the base of the second bipolar transistor, wherein the circuit path does not include the emitters and collectors of the first bipolar transistor and the second bipolar transistor, and does not include a power supply node, the method comprising:

generating a $\Delta Vbe$ voltage at the base of the second bipolar transistor.

13. The method of claim 12, further comprising:

providing a first current to the emitter of the first bipolar transistor using a first current source;

providing a second current to the emitter of the second bipolar transistor using a second current source; and providing a second current to the base of the second bipolar transistor and to the load path of the MOSFET using a third current source.

14. A voltage reference comprising:

a plurality of proportional to absolute temperature (PTAT) cells, wherein each of the plurality of the PTAT cells comprises a first bipolar transistor having a base coupled to an input node and a collector coupled to a common node, a second bipolar transistor having a collector coupled to the common node, a MOSFET having a load path operatively coupled between a base of the second bipolar transistor and the input node, and an amplifier having a first input coupled to an emitter of the first bipolar transistor, a second input coupled to an emitter of the second bipolar transistor and an output coupled to a gate of the MOSFET, wherein the input node of a first PTAT cell of the plurality of PTAT cells is connected to the common node, and an output node of the first PTAT cell of the plurality of PTAT cells is connected to an input node of a subsequent PTAT cell of the plurality of PTAT cells, the load path of the MOSFET is disposed within a circuit path that is directly connected between the input node and the base of the second bipolar transistor, where the circuit path does not include a power supply node, and the collectors of the first and second bipolar transistors are directly connected to a same common node.

15. The voltage reference of claim 14, wherein each of the plurality of PTAT cells further comprises:

a first current source coupled to the emitter of the first bipolar transistor; and a second current source coupled to the emitter of the second bipolar transistor.

16. The voltage reference of claim 15, further comprising a bias current source coupled to the output node of a last PTAT cell of the plurality of PTAT cells.

17. The voltage reference of claim 16, further comprising an output bipolar transistor having an emitter coupled to the common node, a base coupled to the output node of the last PTAT cell of the plurality of PTAT cells, and an emitter coupled to a reference voltage output node of the voltage reference.

18. The voltage reference of claim 17, wherein the first bipolar transistor and the second bipolar transistor of each of the plurality of PTAT cells each comprises a PNP bipolar transistor.

19. A voltage reference circuit comprising:

a first bipolar transistor having an emitter coupled to a common node;

a second bipolar transistor having an emitter coupled to the common node;

a first current source coupled to the common node;

a MOSFET having a load path operatively coupled between a base of the first bipolar transistor and a base of the second bipolar transistor; and an amplifier having a first input coupled to a collector of the first bipolar transistor, a second input coupled to a collector of the second bipolar transistor and an output coupled to a gate of the MOSFET, wherein the load path of the MOSFET is disposed within a circuit path that is connected between the base of the first bipolar transistor and the base of the second bipolar transistor, wherein the circuit path does not include the emitters and collectors of the first bipolar transistor and the second bipolar transistor, and does not include a power supply node.

20. The voltage reference circuit of claim 19, further comprising a second current source coupled to the base of the second bipolar transistor;

a first resistor coupled between the collector of the first bipolar transistor and a first power supply node; and a second resistor coupled between the collector of the second bipolar transistor and the first power supply node.

21. The voltage reference circuit of claim 20, further comprising a third bipolar transistor coupled between the base of the first bipolar transistor and the first power supply node.

22. The voltage reference circuit of claim 21, wherein the first bipolar transistor, the second bipolar transistor, and the third bipolar transistor each comprises a PNP bipolar transistor.

* * * * *